US011926887B2

(12) United States Patent
Almgren et al.

(10) Patent No.: US 11,926,887 B2
(45) Date of Patent: Mar. 12, 2024

(54) MAGNESIUM ALLOY, A PISTON MANUFACTURED BY SAID MAGNESIUM ALLOY AND A METHOD FOR MANUFACTURING SAID PISTON

(71) Applicant: HUSQVARNA AB, Huskvarna (SE)

(72) Inventors: Martin Almgren, Norrahammar (SE); Henrik Assarsson, Jönköping (SE); Simon Hjalmarsson, Jönköping (SE); Xixi Dong, Uxbridge Greater London (GB); Ji Shouxun, Buckinghamshire (GB); Eric Nyberg, Kennewick, WA (US); Per Orestig, Bankeryd (SE)

(73) Assignee: HUSQVARNA AB, Huskvarna (SE)

( * ) Notice: Subject to any disclaimer, the term of this patent is extended or adjusted under 35 U.S.C. 154(b) by 128 days.

(21) Appl. No.: 17/431,898

(22) PCT Filed: Feb. 17, 2020

(86) PCT No.: PCT/SE2020/050178
§ 371 (c)(1),
(2) Date: Aug. 18, 2021

(87) PCT Pub. No.: WO2020/171758
PCT Pub. Date: Aug. 27, 2020

(65) Prior Publication Data

US 2022/0154315 A1 May 19, 2022

(30) Foreign Application Priority Data

Feb. 20, 2019 (SE) ..... 1950219-4

(51) Int. Cl.
*C22C 23/06* (2006.01)

(52) U.S. Cl.
CPC ..... *C22C 23/06* (2013.01)

(58) Field of Classification Search
None
See application file for complete search history.

(56) References Cited

U.S. PATENT DOCUMENTS 6,495,267 B1 * 12/2002 Schenkel ..... C25D 11/026 420/407
2009/0136380 A1 5/2009 Bettles et al.
2017/0129006 A1 5/2017 Bronfin et al.

FOREIGN PATENT DOCUMENTS

CN 1789457 A 6/2006
CN 1928138 A 3/2007
CN 101189354 A 5/2008
CN 102317486 A 1/2012
CN 106636821 A 5/2017
DE 202016105961 U1 12/2016
(Continued)

OTHER PUBLICATIONS

English language machine translation of WO-2018021361-A1. Generated Feb. 16, 2023. (Year: 2023).*
(Continued)

*Primary Examiner* — Brian D Walck
(74) *Attorney, Agent, or Firm* — BURR & FORMAN LLP

(57) ABSTRACT

A magnesium alloy containing: Al: 0.2-1.6 wt. % Zn: 0.2-0.8 wt. % 5 Mn: 0.1-0.5 wt. % Zr 0-0.5 wt. % La: 1-3.5 wt. % Y: 0.05-3.5 wt. % Ce: 0-2 wt. % 10 Nd: 0-2 wt. % Gd: 0-3 wt. % Pr: 0-0.5 wt. % Be: 0-20 ppm the balance being Mg and incidental elements.

20 Claims, 1 Drawing Sheet

(56) References Cited

FOREIGN PATENT DOCUMENTS

| | | | | | |
|---|---|---|---|---|---|
| IN | 104745905 | A | | 7/2015 | |
| JP | 06025788 | A | * | 2/1994 | |
| WO | 2005108634 | A1 | | 11/2005 | |
| WO | 2006105594 | A1 | | 10/2006 | |
| WO | 2006125278 | A1 | | 11/2006 | |
| WO | 2009086585 | A1 | | 7/2009 | |
| WO | 2016178204 | A1 | | 11/2016 | |
| WO | WO-2018021361 | A1 | * | 2/2018 | ..... C22C 23/00 |

OTHER PUBLICATIONS

English language machine translation of JP-06025788-A. Generated May 4, 2023. (Year: 2023).*
English language machine translation of WO 2018/021361. Generated May 4, 2023. (Year: 2023).*
International Search Report and Written Opinion for International Application No. PCT/SE2020/050178 dated Apr. 8, 2020.
Swedish Search Report and Office Action for Application No. 1950219-4 dated Aug. 30, 2019.

* cited by examiner

MAGNESIUM ALLOY, A PISTON MANUFACTURED BY SAID MAGNESIUM ALLOY AND A METHOD FOR MANUFACTURING SAID PISTON

TECHNICAL FIELD

The present disclosure relates to a magnesium alloy. The present disclosure further relates to a piston for a combustion engine manufactured by said magnesium alloy. The present disclosure further relates to a method for manufacturing said piston.

BACKGROUND ART

Handheld power tools, such as chainsaws, clearing saws and power cutters are typically driven by combustion engines, such as two-stroke engines, with an aluminum piston. In such engines the piston is the major cause for vibrations and stress of the product.

Consequently, it is an object of the present disclosure to provide an improved material for pistons of combustion engines.

In particular, it is an object of the present disclosure to provide a material that may withstand the conditions that prevail in piston arrangements of combustion engines.

A further object of the present disclosure is to provide a material which allows for efficient production of cast components. Yet a further object of the present disclosure is to provide a material for pistons of combustion engines which may be produced at low cost.

SUMMARY OF INVENTION

Magnesium is a light-weight metal and is used as material in certain components to reduce weight. For example, WO2009/086585 discloses a magnesium alloy which is intended to be used for cylinder blocks for engines of vehicles. In operation of the vehicle, such cylinder blocks are subjected to high stress under elevated temperature and therefore the material of the cylinder block may creep during prolonged periods of use. Accordingly, the alloy of WO2009/086585 is optimized for achieving excellent creep-strength in the cylinder blocks in combination with good castability of the alloy. To achieve this, the alloy comprises balanced amounts of the rare-earth metals cerium and lanthanum which provides increased creep-strength and improved castability. Aluminum is included in the alloy of WO2009/086585 in small amounts to increase the creep-strength further.

In general, most known magnesium alloys are associated with various drawbacks which makes them unsuitable as material for pistons of combustion engines. For example, known magnesium alloys have poor fatigue properties at elevated temperatures. The alloys are therefore not capable of being used at a temperature of more than 200° C. because of softening and reduced working life. Furthermore, many known magnesium alloys suffers from poor die-castability which makes them unsuitable for large scale casting production methods. Moreover, many of the known magnesium alloy for high temperature use are costly and not able to be used in large-scale manufacturing.

According to a first aspect of the present disclosure at least one of these objects is met by a magnesium alloy containing:

Al: 0.2-1.6 wt %
Zn: 0.2-0.8 wt %

Mn: 0.1-0.5 wt %
Zr 0-0.5 wt %
La: 1-3.5 wt %
Y: 0.05-3.5 wt %
Ce: 0-2 wt %
Nd: 0-2 wt %
Gd: 0-3 wt %
Pr: 0-0.5 wt %
Be: 0-20 ppm
The balance being Mg and incidental elements.

In a second aspect the present disclosure relates to a piston for a combustion engine said piston manufactured by the magnesium alloy according to the first aspect. The piston may be configured for a two-stroke combustion engine of a handheld power tool. The power tool may for example be chainsaw or a clearing saw. In an embodiment the surface of the piston is coated by a layer of magnesium oxide In a third aspect the present disclosure relates to a method for manufacturing a piston according to the second aspect Practical trials have shown that the magnesium alloy according to the present disclosure exhibits very good mechanical properties in terms of tensile strength at elevated temperatures, such as up to 400° C. For a piston used in a combustion engine this is a good measure on resistance to thermal fatigue of the piston. Furthermore, the practical trials showed that the magnesium alloy according to the present disclosure has excellent castability properties for high pressure die casting. Castability of the alloy may be determined in terms of the following properties: fluidity of the molten alloy, hot tearing resistance capability, die soldering resistance capability, burning resistance capability and surface quality, such as the smoothness and homogeneity of the surface.

It is believed that the favorable properties of the magnesium alloy according to the present disclosure is a result of a balanced amount of La and Y in combination with balanced amounts of the alloying elements Al, Mn, Zn, Zr.

The tensile strength was found to increase even further when one or more of the optional rare earth elements selected from the group of Ce, Nd, Gd, Pr was included in the magnesium alloy according to the present disclosure.

Without being bound by theory, the favorable properties of the magnesium alloy of the present disclosure may be explained as follows. In an Al containing Mg-matrix, Rare-earth elements such as La, Ce, Nd, Gd, Pr form eutectic Al—Re phase more easily than Mg—Al eutectic phase and suppress thereby the quantity of Mg—Al eutectic phase. The Mg—Al eutectic phase has an negative impact on high-temperature strength of the alloy because the Mg—Al eutectic phase has a low melting point of 437° C., and it is unstable at elevated temperatures especially above 175° C. The Al—Re eutectic phase on the other hand has high thermal stability at elevated temperatures. Moreover, the addition of Rare earth element results in that Mg—Re eutectic phase is formed in the grain boundaries of the Mg—Al matrix. This eutectic phase is stable at elevated temperatures and prevent or reduce crystal growth in the solidified alloy when it is used at high temperatures. Overall, this results in good mechanical properties of the alloy at high temperatures. Lanthanum (La) is a Re-element which is available at low cost and readily forms stable eutectic phase with magnesium. In addition, La has low solubility and low eutectic composition point in magnesium at eutectic temperature. This improves castability because the solidification temperature range is reduced whereby solidification of the alloy is achieved in short time. The castability may be improved by increased amount of La, because this moves the alloy composition closer to the eutectic point and reduces the solidification range further. To achieve both good mechanical properties and castability, La may be present in an amount of 1-3.5 wt. %. In one alternative of the alloy according to the present disclosure La is present in an amount of 1.5-3.5 wt. % or 2.5-3.5 wt. %.

In a second alternative of the alternative of the alloy according to the present disclosure La is present in an amount of 1.5-2 wt. % or 1.5-1.8 wt. %.

Cerium (Ce) has similar behavior as La and may therefore replace some of La in the Mg alloy of the present disclosure: Ce may be present in the Mg alloy in an amount of 0-2 wt. %. For example, when La is present in an amount of 1.5-2 wt. % Ce may be present in an amount of or 0.5-1.5 wt. % or 1-1.2 wt. % or 0.5-1 wt. %.

Neodymium (Nd), Gadolinium (Gd) and Praseodymium (Pr) are Rare-earth elements that have good solubility in Mg and may therefore be included in the magnesium alloy according to the present disclosure in order to increase the amount of Mg—Re eutectic phase and thereby the mechanical strength of the alloy.

For example, the amount of Nd may be 0-2 wt. % preferably 0.5-1.5 wt. %. The amount of Gd may be 0-3 wt. % preferably 1-3 wt. % or 1-2 wt. % or 1.4-1.6. The amount of Pr may be 0-0.5 wt. %, or 0-0.3 wt. % or 0.02-0.3 wt. % or 0.1-0.2.

An advantage of using the particular alloy elements selected from La, Ce, Pr, Nd and Ge in the alloy of the present disclosure is that these elements are available in form of mixed rare earth metal, so called "mischmetal". Such mixed rare earth metal is available in specific ratios on the market at comparatively low cost and allows thus for production of a cost effective alloy with good mechanical properties and good castability. According to an alternative, La may be 1.5-1.65 wt. % when Gd is 1-2 wt. %; Nd is 0.5-1.5 wt. %; Pr is 0.1-0.2 wt. %; Ce is 0.1-1.2 wt. %.

Yttrium (Y). Additions of Y refine the grains and form high melting point $Mg_{24}Y_5$ phases in the matrix which improves the microstructure and mechanical properties of the alloys. During solidification, the Y atoms aggregate from the matrix to form block shaped particles with high Y content and non-equilibrium eutectics. The formation of block shaped particles inevitably experiences the process of nucleation and growth according to the principle of phase transformation. Due to the composition fluctuation, the nuclei are formed in the micro-areas with high Y content. Y atoms diffuse toward the nuclei, and lead to nuclei growth. Simultaneously, other nuclei form in other micro-areas of the non-equilibrium eutectic phase. The non-equilibrium eutectic phase and the block shaped particles in the matrix can significantly contribute the improvement of mechanical properties at elevated temperature. Y may be present in the Mg alloy of the present disclosure in an amount of 0.05-3.5 wt. %. The amount of Y may be reduced when the Mg-alloy comprises Re-elements selected from the group of Ce, Gd, Nd and Pr due to that a substantial contribution to mechanical strength is made by the additional Re-elements. Y may thus be 0.05-0.5 wt. % or 0.05-0.2 wt. % or 0.05-0.15 wt. %. Reduced Y is advantageous because Y is an expensive alloying element. In order to achieve sufficient mechanical strength of alloy the amount of Y is preferably increased when the amount of La is high and the amount of other Re-elements is low. In such case Y may be 1.5-3.5 wt. % or 2.0-3.0 wt. %.

To achieve very high mechanical strength at elevated temperatures in combination with good castability the sum of La and at least one element selected from the group of Y, Ce, Nd, Pr and Gd may be 5-6 wt. %. Typically, mechanical strength and castability increases with higher amounts of Re-elements. However, so do also production costs. Therefore, 5-6 wt. % has been found to produce an alloy having a good balance between mechanical strength, castability and production economy.

Aluminium (Al) is added to achieve good mechanical properties at elevated temperatures in the magnesium alloy according to the present disclosure. Although the detailed mechanism is still unclear in scientific point of views, it has shown that small amounts of Al in Mg—Re alloys is beneficial to the mechanical properties at elevated temperatures and thus improves the tensile strength of the alloy. It has further shown that the strengthening effect of Al in Mg—Re alloys becomes invalid when Al is added in higher amounts. In other words, high additions of aluminium should be avoided as it is seriously detrimental to the mechanical properties at elevated temperature. The Al content of the Mg-alloy is therefore 0.2-1.6 wt. %, In one alternative of the Mg-alloy the Al content is 0.3-0.6 wt. %. In a second alternative of the Mg-alloy, the Al content is 0.2-1.5 wt. %, 0.5-1.5 wt. % or 0.7-1.1 wt. %.

Manganese (Mn) helps to prevent die soldering and improves thus the die releasing capability of the Mg alloy according to the present disclosure. Mn may further enhance the strength of the alloy. However, more importantly, Mn contributes to neutralize impurities in the alloy. Namely, Mn combines with Fe to alter the morphology of Fe-containing compounds from needles to nodular to reduce the harmful effect of Fe. The amount of Mn is 0.1-0.5 wt. % or 0.15-0.5 wt. % or 0.2-0.3 wt. %.

Zinc (Zn) is a common element used in Mg alloys because of its benefits in providing improved mechanical properties, machinability and castability. The amount of Zn is 0.2-0.8 wt. % preferably, 0.3-0.6 or 0.4-0.5 wt. %.

Zirconium (Zr) is a strong grain refinement element in magnesium alloys and improves the mechanical properties at room temperature and at elevated temperatures. It is generally advantageous to add Zr in the magnesium alloy to improve use at elevated temperatures. Moreover, Zr can react with Rare earth elements to form intermetallic compounds that improves mechanical properties at elevated temperatures. The amount of Zr content may be 0-0.5 wt. % or 0.1-0.5 wt. %.

Beryllium (Be) is commonly added to casting magnesium alloys to prevent oxidation of the magnesium alloy. As little as up to 20 ppm causes a protective beryllium oxide film to form on the surface. Preferably, as usual, the Be level is controlled to be about 20 ppm for example 5-20 ppm.

The Mg alloy according to the present disclosure may further comprise incidental elements. The incidental elements may be alloy elements that have negligible or insignificant influence on the properties of the Mg-alloy. The incidental elements may in some instances be considered impurities. Non-limiting examples of incidental elements are: Fe<0.3 wt. %, Si<0.05 wt. %, Dy<0.05 wt. %, Ni<0.03 wt. %, Sn<0.5 wt. %, Er<0.01 wt. %, Ca<1 wt. % and Sr<0.5 wt. %.

Typically, the total amount of incidental elements are 0-3.0 wt. % in Mg-alloy.

Magnesium (Mg) constitutes the balance in the Mg alloy. Typically, the content of Mg is less than, or equal to 93.5 wt. %. For example 92.0 to 93.5 wt. %.

In an embodiment the magnesium alloy according to the present disclosure contains: 0.2-0.8 wt. % Al, 0.3-0.6 wt. % Zn, 0.15-0.3 wt. % Mn, 0-0.5 wt. % Zr, 1.5-2 wt. % La, 0.05-0.15 wt. % Y, 0.5-1 wt. % Ce, 0.8-1.2 wt. % Nd, 1.4-1.6 wt. % Gd, 0-0.3 wt. % Pr, 0-20 ppm Be. The balance being Mg and incidental impurities.

An example of such an alloy is: 0.5 wt. % Al; 0.5 wt. % Zn; 0.3 wt. % Mn; 1.6 wt. % La; 1 wt. % Ce; 1 wt. % Nd; 1.5 wt. % Gd; 0.05 wt. % Pr; 0.1 wt. % Y; balance Mg and incidental impurities.

In an embodiment the magnesium alloy according to the present disclosure contains: 0.2-1.5 wt. % Al, 0.2-0.6 wt. % Zn, 0.1-0.4 wt. % Mn, 0-0.5 wt. % Zr, 1.5-3.5 wt. % La, 0-1 wt. % Ce, 0-0.5 wt. % Nd, 0-0.5 wt. % Gd, 1.5-3 wt. % Y, 0-0.3 wt. % Pr, 0-20 ppm Be.

An example of such an alloy is: 1 wt. % Al; 0.4 wt. % Zn; 0.3 wt. % Mn; 3 wt. % La; 3 wt. % Y; balance Mg and incidental impurities.

DESCRIPTION OF EXAMPLES

The magnesium alloy according to the present disclosure is hereinafter described by the following non-limiting examples.

Example 1

Alloy Manufacturing

Pure magnesium ingots, Mg-30 wt. % Nd, Mg-30 wt. % Y, Mg-30 wt. % Gd and Mg-10 wt. % Mn master alloys and a master alloy containing the mixture of La and Ce in magnesium were used as starting materials. These master alloys were: 35 wt. % La-65 wt. % Ce or 51 wt. % Ce-28 wt. % La-16 wt. % Nd-5 wt. % Pr or 50 wt. % Ce-32 wt. % La-12 wt. % Nd-6 wt. % Pr or 51 wt. % Ce-27 wt. % La-18 wt. % Nd-4 wt. % Pr.

Each element was weighted at a special ratio with an extra amount for burning loss during melting. During alloy making, a top loaded electrical resistant furnace was used to melt the metal in a steel crucible under protection of N2+(0.05-0.1) vol. % SF6 or $SO_2$.

A batch of 10 kg alloy was melted at a temperature of 720° C. each time. After the melt was homogenised in the crucible, a mushroom sample with ϕ60×6.35 mm testing part for composition analysis was made by casting melt directly into a steel mould. The casting was cut off 3 mm from the bottom before performing composition analysis. The composition was analysed using an optical mass spectroscopy, in which at least five spark analyses were carried out and the average value was taken as the chemical composition of the alloy.

After composition analysis, the casting samples were made by a 4500 kN cold chamber HPDC machine, in which all casting parameters were fully monitored and recorded. The pouring temperature was controlled at 700° C., which was measured by a K-type thermocouple. Casting was made in a die for making ASTM B557standard samples for testing mechanical properties. The die was heated by the circulation of mineral oil at 250° C. The mechanical properties and thermal conductivity were measured following a standard method defined by ASTM. The fluidity, the hot tearing resistance capability, the die soldering resistance capability, the burning resistance capability and the surface quality of the manufactured alloy were confirmed excellent, which demonstrated the good castability of the present alloy.

A number of other samples were made in accordance with the same method. All the sample were tested in the same condition. The tensile properties tested at elevated temperatures were carried out using a hot chamber and hold the sample at the specified temperatures for 40 min after reaching the required temperatures. The alloy compositions and tensile test results are shown in Table 1 on the following page.

TABLE 1

| Magnesium alloy (wt. %)* | Tensile testing temperature (° C.) | Yield strength (MPa) | Ultimate tensile strength (MPa) | Broken elongation (%) |
|---|---|---|---|---|
| Mg-1.6La-1.0Ce-1.0Nd-1.5Gd-0.1Y-0.1Pr-0.3Zn-0.3Al-0.3Mn | 25 | 170 | 200 | 4.4 |
| | 150 | 145 | 170 | 15.3 |
| | 250 | 113 | 124 | 27.1 |
| | 300 | 91 | 96 | 27.5 |
| Mg-3.0La-3.0Y-0.3Zn-0.5Al-0.3Mn | 25 | 167 | 191 | 3.6 |
| | 150 | 140 | 172 | 8.8 |
| | 250 | 107 | 128 | 11.2 |
| | 300 | 95 | 101 | 13.3 |
| Mg-2.1La-0.5Ce-0.6Nd-1.0Gd-0.5Y-0.2Zn-0.2Al-0.1Mn | 25 | 175 | 205 | 3.5 |
| | 150 | 142 | 173 | 14.7 |
| | 250 | 108 | 121 | 25.1 |
| | 300 | 88 | 92 | 26.4 |
| Mg-1.3La-1.2Ce-0.5Nd-1.2Gd-1.0Y-0.2Zn-0.2Al-0.3Mn | 25 | 164 | 202 | 4.1 |
| | 150 | 138 | 164 | 16.7 |
| | 250 | 105 | 119 | 27.1 |
| | 300 | 84 | 94 | 28.7 |
| Mg-2.0La-1.0Ce-3.0Y-1.0Al-0.2Mn | 25 | 171 | 185 | 3.8 |
| | 150 | 135 | 167 | 8.2 |
| | 250 | 102 | 124 | 11.6 |
| | 300 | 90 | 98 | 14.3 |

*Be is also present in amounts of up to 20 ppm

All the samples in the table show a yield strength that is above 80 MPa at an elevated temperature of 300° C. The samples in table 1 are thus suitable for piston applications.

Example 2

Piston Manufacturing

An alloy was made as the same method in example 1. The alloy composition was finalised as Mg-1.6La-1.0Ce-1.0Nd-1.5Gd-0.1Y-0.1Pr-0.3Zn-0.3Al-0.3Mn (wt. %).

A set of dies was designed specifically for the piston manufacturing. The die was fitted into a 4500 kN cold chamber HPDC machine. All the casting parameters were fully optimised and monitored during casting. The pouring temperature was controlled to 700° C., which was measured by a K-type thermocouple. The dies were heated by the circulation of mineral oil at 250° C. The cast pistons were machined to the final shapes.

DETAILED DESCRIPTION OF EMBODIMENTS

Figure 1:
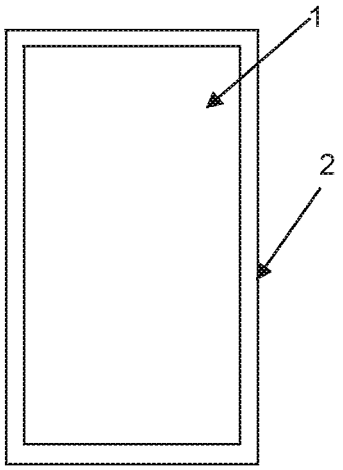
FIG. 1: A schematic drawing of a piston for a combustion engine according to the present disclosure.
Figure 2:
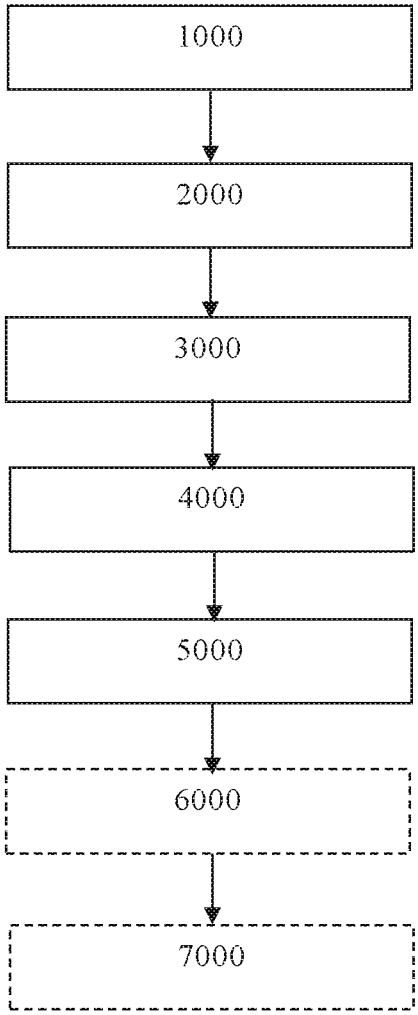
FIG. 2: A flowchart showing schematically the steps of a method according to the present disclosure.

FIG. 1 shows schematically a piston 1 according to the present disclosure for a combustion engine. Here exemplified as a piston for a two-stroke engine for a hand-held motor tool. The piston 1, comprises, i.e. is manufactured from, the magnesium alloy according to the first aspect of the present disclosure. The piston 1 is provided with a coating 2 of magnesium oxide. The coating 2 may be provided on the entire outer surface of the piston 1, as shown in FIG. 2.

However, it is possible to provide the coating 2 on only a portion of the outer surface of the piston 1.

The piston may be manufactured by the following method. The steps of the method may be followed in FIG. 2.

Thus, in a first step 1000 of the method, a magnesium alloy according to the present disclosure is provided. Typically, the magnesium alloy is provided in form of pre-manufactured solid pieces such as ingots. In a second step 2000, the magnesium alloy is melted such that it assumes a liquid state. Melting is performed by heating the magnesium alloy above its melting point. Typically the magnesium alloy may thereby be heated to a temperature of 720° C. or above. In a third step 3000, the molten magnesium alloy is cast, i.e. poured into a mold having a mold cavity which defines the shape of a piston for a combustion engine. For example, the mold cavity defines the shape of a piston for a two-stroke combustion engine. In a fourth step 4000 the molten magnesium alloy is allowed to solidify for a predetermined time in the mold cavity. The solidification time depends on dimensions of the piston and casting conditions and may be determined in advance by e.g. practical trials. In a fifth step 5000, the piston is removed, from the mold cavity. The mold may thereby comprise two mold halves which may are movable away from each other to allow access to the mold cavity and the solidified piston.

Casting of the piston is preferably made by High Pressure Die Casting (HPDC). In this process, molten metal is injected under velocity and high pressure into a forming cavity that is formed between two mold halves that are clamped together. The HPDC process allows for fast production of components with high dimensional accuracy due to that the forming cavity is rapidly filled with molten metal.

The steps of melting of the magnesium alloy and the step of removing the solidified piston may be comprised in the High Pressure Die Casting equipment.

After removal of the solidified piston, in an optional sixth step 6000, the piston may be subjected to a machining operation, such a drilling and or turning into final shape.

Finally, the piston may be subjected to an optional seventh step 7000 of providing a coating on the surface of the piston. The coating is preferably a coating of magnesium oxide and may be achieved by Plasma Electrolytic Oxidation (PEO), which is a known electrochemical surface treatment process for generating oxide coatings on metals, such as magnesium. The Plasma Electrolytic Oxidation process achieves a hard and continuous oxide coating which offers protection against wear, corrosion and heat. An advantage of PEO is that the coating is a chemical conversion of the substrate metal into its oxide, and the coating therefore grows both inwards and outwards from the original metal surface. Because it grows inward into the substrate, it has excellent adhesion to the substrate metal.

It is appreciated that the piston may have any suitable dimensions for its intended application.

It is further appreciated the piston may be configured for four-stroke engines.

Moreover, casting of the magnesium alloy may be achieved by other suitable casting processes. For example, sand casting, low-pressure die-casting, semi-solid metal processing or permanent mold gravity die-casting.

The invention claimed is:

1. A magnesium alloy consisting of:
Al: 0.2-1.6 wt. %
Zn: 0.2-0.8 wt. %
Mn: 0.1-0.5 wt. %
Zr 0-0.5 wt. %
La: 1-3.5 wt. %
Y: 0.05-3.5 wt. %
Ce: 0-2 wt. %
Nd: 0-2 wt. %
Gd: 0-3 wt. %
Pr: 0-0.5 wt. %
Be: 0-20 ppm
the balance being Mg and incidental elements in an amount of 0-3 wt. %.

2. The magnesium alloy according to claim 1 wherein the amount of Al is 0.3-0.8 wt. %.

3. The magnesium alloy according to claim 1, wherein the amount of Zn is 0.3-0.6 wt. %.

4. The magnesium alloy according to claim 1, wherein the amount of La is 1.5-2 wt. %.

5. The magnesium alloy according to claim 1, wherein the amount of Y is 0.05-0.2 wt. %.

6. The magnesium alloy according to claim 1, wherein the amount of Ce is 0.5-1.5 wt. %.

7. The magnesium alloy according to claim 1, wherein the amount of Nd is 0.5-1.5 wt. %.

8. The magnesium alloy according to claim 1, wherein the amount of Gd is 1-3 wt. %.

9. The magnesium alloy according to claim 1, wherein the amount of Pr is 0-0.3 wt %.

10. The magnesium alloy according to claim 1, wherein the amount of Al is 0.2-1.5 wt %.

11. The magnesium alloy according to claim 10, wherein the amount of Y is 1-3.5 wt. %, and
wherein the amount of La is 1.5-3.5 wt. %.

12. The magnesium alloy according to claim 1, wherein a sum of amounts of La and at least one element selected from the group of Y, Ce, Nd, Gd, Pr is 5-6 wt. %.

13. The magnesium alloy according to claim 1, wherein the alloy contains: 0.2-1.5 wt. % Al, 0.2-0.6 wt. % Zn, 0.1-0.4 wt. % Mn, 0-0.5 wt. % Zr, 1.5-3.5 wt. % La, 0-1 wt. % Ce, 0-0.5 wt. % Nd, 0-0.5 wt. % Gd, 1.5-3 wt. % Y, 0-0.3 wt. % Pr, 0-20 ppm Be.

14. The magnesium alloy according to claim 1, wherein the amount of Mg is ≤93.5 wt. %.

15. A piston for a combustion engine, the piston being manufactured from a magnesium alloy consisting of:
Al: 0.2-1.6 wt. %
Zn: 0.2-0.8 wt. %
Mn: 0.1-0.5 wt. %
Zr 0-0.5 wt. %
La: 1-3.5 wt. %
Y: 0.05-3.5 wt. %
Ce: 0-2 wt. %
Nd: 0-2 wt. %
Gd: 0-3 wt. %
Pr: 0-0.5 wt. %
Be: 0-20 ppm
the balance being Mg and incidental elements in an amount of 0-3 wt. %.

16. The piston according to claim 15, wherein the piston is configured for a two-stroke engine of a hand-held power tool, and
wherein the piston comprises an oxidized surface layer.

17. A method for manufacturing a piston for a combustion engine comprising the steps:
providing a magnesium alloy according to claim 1;
melting the magnesium alloy;
casting the magnesium alloy into a mold cavity defining the shape of a piston;
solidification of the magnesium alloy in the mold cavity;
removing the solidified piston from the mold cavity.

18. The method according to claim 17, wherein the step of casting the magnesium alloy is made by High Pressure Die Casting.

19. The method according to claim 17 further comprising a step of providing an oxide layer on the surface of the piston by Plasma Electrolytic Oxidation.

20. A magnesium alloy containing 0.3-0.8 wt. % Al, 0.3-0.6 wt. % Zn, 0.15-0.3 wt. % Mn, 0-0.5 wt. % Zr, 1.5-2 wt. % La, 0.05-0.15 wt. % Y, 0.5-1 wt. % Ce, 0.8-1.2 wt. % Nd, 1.4-1.6 wt. % Gd, 0-0.3 wt. % Pr, 0-20 ppm Be; the balance being Mg and incidental elements in an amount of 0-3 wt. %.

* * * * *